United States Patent [19]

Lenk et al.

[11] Patent Number: 4,522,170

[45] Date of Patent: Jun. 11, 1985

[54] LOW ENGINE OIL SENSING METHOD

[75] Inventors: Michael Lenk, Toledo; Richard S. Podiak, Maumee, both of Ohio

[73] Assignee: Champion Spark Plug Company, Toledo, Ohio

[21] Appl. No.: 605,350

[22] Filed: Apr. 30, 1984

[51] Int. Cl.[3] ..... F02B 77/00

[52] U.S. Cl. ..... 123/198 DC; 123/198 D; 123/196 S; 73/115; 116/227; 184/108

[58] Field of Search ..... 123/196 S, 198 D, 196 CP, 123/198 DC, 198 DB; 73/115; 116/227; 184/108

[56] References Cited

U.S. PATENT DOCUMENTS 2,529,775 11/1950 Maddox ..... 123/196 S
4,429,670 2/1984 Ulanet ..... 123/196 D

*Primary Examiner*—E. Rollins Cross

*Attorney, Agent, or Firm*—Oliver E. Todd, Jr.

[57] ABSTRACT

A method for sensing when the quantity of oil in the crankcase of a reciprocating piston engine is inadequate for proper lubrication while the engine is operating. During engine operation, the crankcase gas pressure cycles between positive and negative values as the piston reciprocates. Positive crankcase gas pressures are vented through a check valve. The resulting cyclic vacuum in the crankcase has a peak and average magnitude which is a function of the quantity of oil in the crankcase. For a constant speed and substantially constant load engine, the crankcase vacuum can be used to indicate the approximate quantity of oil in the crankcase. For constant or variable speed and load engines, a drop in the crankcase vacuum below a predetermined level can be used to automatically stop the engine prior to damage by inadequate lubrication.

7 Claims, 6 Drawing Figures

LOW ENGINE OIL SENSING METHOD

TECHNICAL FIELD

The invention relates to a method for sensing oil level in an engine and more particularly to an improved method for sensing when the quantity of oil present in the crankcase of an operating reciprocating piston engine is sufficient for proper lubrication.

BACKGROUND ART

A four-stroke reciprocating piston internal combustion engine has a crankcase which is partially filled with a lubricating oil. In one type of engine, a pump circulates the oil under pressure to lubricate different moving parts of the engine. A loss of oil pressure is easily monitored to automatically stop the engine or to alert an operator in the event that there is insufficient oil in the crankcase. In another type of engine, the oil in the crankcase is highly agitated or splashed about to lubricate the moving engine parts. If the quantity of oil within the engine crankcase decreases through leakage or oil consumption by the engine, the engine may be damaged by inadequate lubrication. In smaller engines and particularly single cylinder engines of the type having splash lubrication rather than forced lubrication, the lubricating oil is constantly agitated and some of the oil will be coated on the surfaces within the crankcase. The small size of the crankcase and the constant agitation of the oil makes crankcase oil level sensing extremely difficult during engine operation using prior art techniques. Engines of this type rely upon the operator checking the oil level prior to starting the engine and, if the engine is operated for long periods of time, periodically stopping the engine to check the oil level. Damage to many small engines due to insufficient lubrication could be prevented if reliance on this human factor is eliminated.

For small engines, electronic oil sensors are not practical due to the cost factor. Many small engines are manually started and use a magneto or a capacitive discharge ignition system for generating a signal to operate the ignition system. There is no generator or alternator and battery present on the engine for operating electronic circuits, such as an electronic oil level sensing system if such a system were developed. The cost of adding a generator and battery to a manually started small engine plus the cost of an electronic oil volume sensor may render the engine unsalable for many applications.

DISCLOSURE OF THE INVENTION

The invention is directed to an improved method for sensing when the volume of oil in the crankcase of an internal combustion engine falls below a predetermined safe level. Preferably, means is provided for automatically stopping the engine when a low engine oil level or volume is sensed.

In a conventional reciprocating piston internal combustion engine, crankcase gases are vented to prevent a positive pressure buildup in the crankcase as one or more pistons reciprocate. If the crankcase is sealed, the gas pressure within the crankcase will pulsate with a vacuum to pressure swing as the piston reciprocates and will eventually build up to a pulsating positive pressure due to combustion gases blowing by the piston rings. As a consequence of the positive pressure in the crankcase, during a portion of each combustion chamber operating cycle the crankcase will have a higher pressure than the combustion chamber and some crankcase oil may be forced past the piston rings into the combustion chamber where it is burned. More importantly, the positive pressure may force oil past the seals and particularly the crankshaft seal. In order to eliminate this problem, a check valve, typically of the reed type, is provided for venting above atmospheric pressure gases from the crankcase. The stroking of the piston in conjunction with the pressure relief valve results in primarily a cyclic subatmospheric pressure or vacuum within the crankcase.

In accordance with the invention, it has been found that the average magnitude of the vacuum within the crankcase is translatable to the total quantity of oil in the crankcase. This is due to the fact that the reciprocating piston has a fixed displacement and the volume of gas within the crankcase is an inverse function of the quantity of oil. As the quantity of crankcase oil decreases, the volume of gas in the crankcase will increase to replace the lost oil. Since the piston has a fixed displacement, the peak and average magnitudes of the crankcase vacuum will vary inversely with the gas volume within the crankcase. The crankcase vacuum is not affected by the high agitation of the oil which results in the formation of oil droplets suspended in the crankcase gas and coating the surfaces within the crankcase. It should be noted that the droplets are still a noncompressible liquid and not a vapor. The magnitude of the peak crankcase vacuum is dependent upon the gas volume in the crankcase, which remains unchanged regardless of where the oil is located.

The average vacuum level within the engine crankcase is monitored and used as an indication of the quantity of oil present in the crankcase. If the vacuum level is below a predetermined level, the engine may be stopped automatically by disabling the engine ignition system. In one embodiment of the invention, the low crankcase vacuum trips a pressure sensor which must be manually reset before the engine can be restarted. In another embodiment, the engine will restart after a shutdown, but will subsequently shutdown again if the quantity of oil in the crankcase is insufficient.

BEST MODE FOR CARRYING OUT THE INVENTION

The present invention is based upon the discovery that the quantity of oil present in the crankcase of relatively small four-stroke, reciprocating piston internal combustion engines can be determined by measuring the vacuum within the crankcase. As the engine piston reciprocates, the gas pressure within the crankcase pulsates. Above atmospheric pressure gases are vented through a check valve to maintain an average vacuum within the crankcase. This crankcase vacuum reduces oil losses past the piston rings and seals which may occur during the intake stroke, for example, if the crankcase were pressurized. It will be apparent that the reciprocating piston has a fixed displacement. For any given engine speed, the vacuum established within the crankcase will vary inversely with the volume of gas in the crankcase. Thus, when the crankcase is filled with oil to its maximum operating level, the gas volume within the crankcase is at a minimum and the vacuum will be at a maximum. As the oil volume in the crankcase decreases, the gas volume will increase and the vacuum will decrease.

Figure 1:
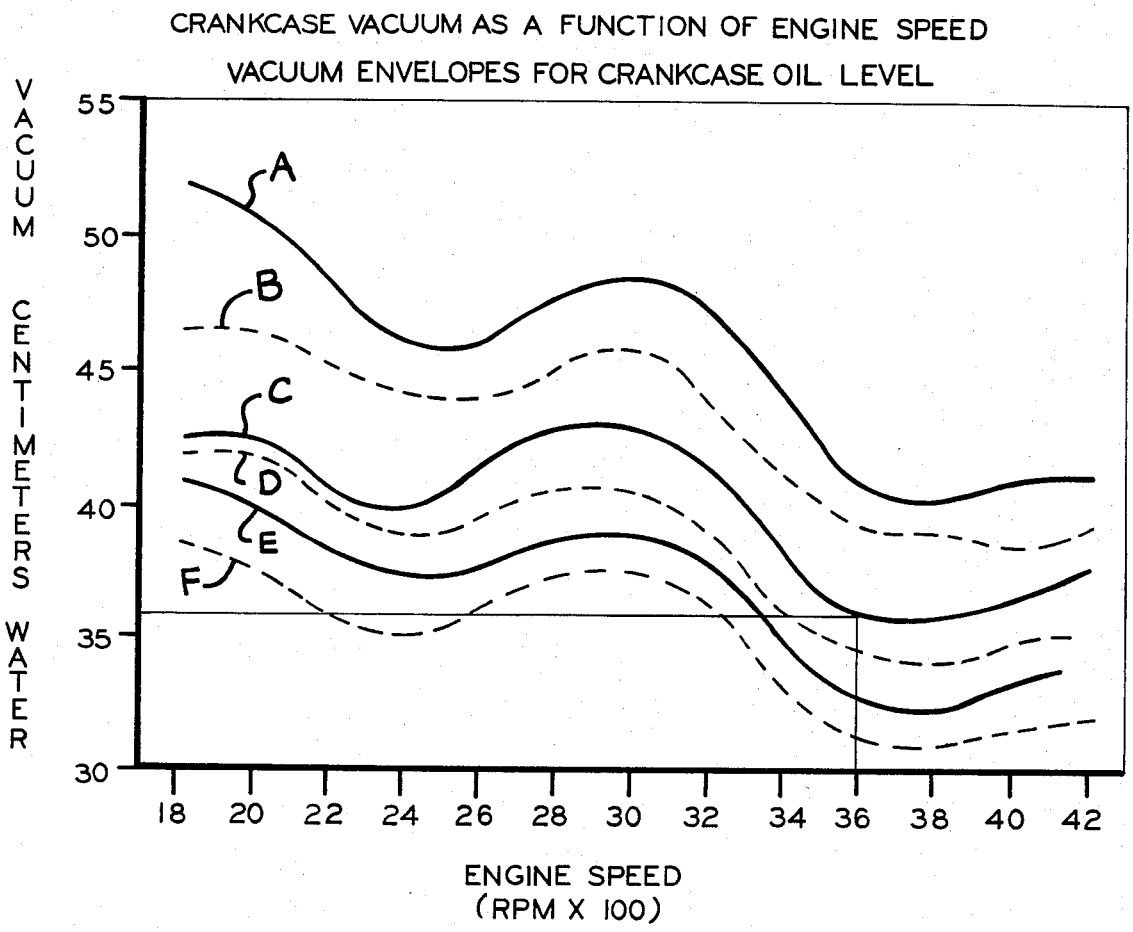
FIG. 1 is a graph illustrating crankcase vacuum versus engine speed for an exemplary engine operated with different quantities of oil in the crankcase and under different loads.

FIG. 1 is a graph illustrating the crankcase vacuum as a function of engine speed for an exemplary small internal combustion engine, such as an eight horsepower, single cylinder, spark ignited engine. The crankcase of the exemplary engine is designed to hold 3 pints of lubricating oil. Line A on the graph of FIG. 1 shows the crankcase vacuum for various engine speeds when the engine is operating under a no-load condition and line B shows the crankcase vacuum for various engine speeds when the engine is operated under load and wide open throttle with 3 pints of oil in the crankcase. Line C shows the crankcase vacuum for various engine speeds when the engine is operating under a no-load condition and line D shows the crankcase vacuum for various engine speeds when the engine is operated under load and wide open throttle with 2 pints of oil in the crankcase. Line E shows the crankcase vacuum for various engine speeds when the engine is operating under a no-load condition and line F shows the crankcase vacuum for various engine speeds when the engine is operated under load and wide open throttle with 1.5 pints of oil in the crankcase. The lines on the graph of FIG. 1 show that for a predetermined load on the engine and with a predetermined quantity of oil in the engine crankcase, the crankcase vacuum is highest at idle and generally drops off as the engine speed is increased. However, the lines are not linear, probably due to the effects of flutter in the check valve which vents the crankcase and to loss of effectiveness in the crankshaft seal to seal against air flow with increased speeds. When the engine is operated under load with a wide open throttle and other conditions unchanged, the magnitude of the crankcase vacuum generally decreases below that present when operating under no-load. This drop may be due to increased combustion gases blowing by the piston rings since the combustion chamber pressures increase under increased loads. FIG. 1 also shows that when the lubricating oil volume in the crankcase drops from full, as illustrated by lines A and B, to $\frac{2}{3}$ full, as illustrated by lines C and D, to half full, as illustrated by lines E and F, the crankcase vacuum drops for any given engine speed.

The magnitude of the crankcase vacuum is used as an indication of the quantity of oil present in the crankcase while the engine is operating. If the engine is to be operated at a fixed speed, such as when the engine drives an electric generator, a crankcase vacuum gauge may be calibrated to indicate the oil level or quantity in the crankcase. The engine also can be stopped automatically if the engine vacuum drops below a predetermined magnitude. For example, if the exemplary engine having the operating parameters shown in FIG. 1 is operated at a constant speed of 2,000 rpm, the engine may be stopped when the crankcase vacuum drops to about 40 centimeters of water. If the same engine is to be operated at speeds which vary up to 3600 rpm, the engine can be automatically stopped when the magnitude of the crankcase vacuum drops to 36 centimeters of water, for example. Or, the engine can be stopped at a higher vacuum magnitude, such as about 39 centimeters of water, if the operator is more conservative.

Figure 2:
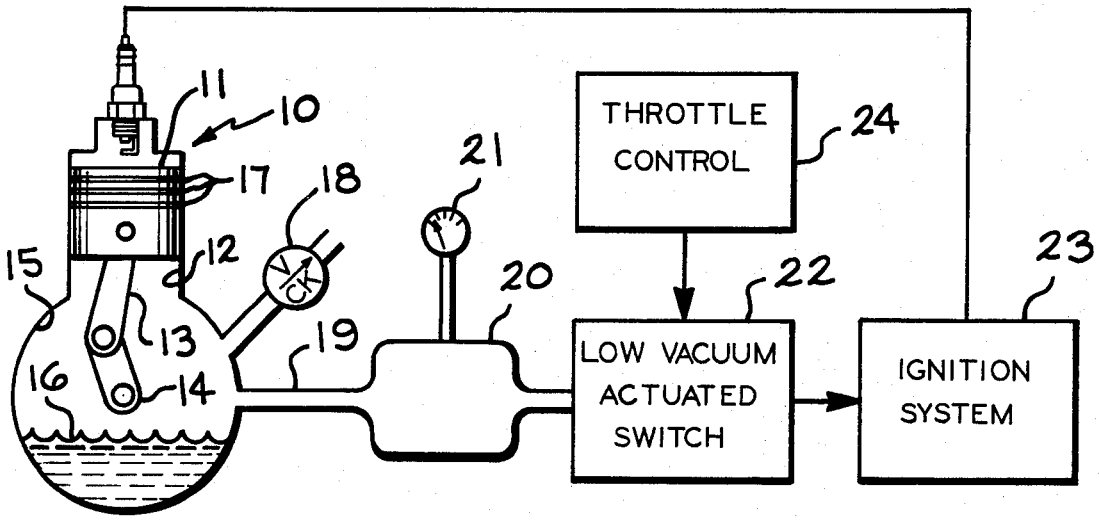
FIG. 2 is a diagramatic illustration showing a single cylinder internal combustion engine including apparatus according to the invention for stopping the engine in response to low crankcase oil.

FIG. 2 illustrates diagramatically an internal combustion engine 10 having a piston 11 which reciprocates in a cylinder 12. The piston 11 is connected through a connecting rod 13 to a crankshaft 14 which is located in a crankcase 15. The crankcase 15 holds a volume of lubricating oil 16. As the crankshaft 14 rotates during operation of the engine 10, the oil 16 is highly agitated. Small drops of oil are dispersed in the crankcase gas and coat exposed surfaces within the crankcase 15 to lubricate moving engine parts. Because of the high agitation and dispersion of the oil, there is no easily measured oil surface or level during engine operation.

As the piston 11 reciprocates in the cylinder 12, there is a cyclic gas pressure in the crankcase 15. If the crankcase is sealed, a positive or above atmospheric gas pressure will build up in the crankcase due to combustion gases blowing by piston rings 17. The pressure buildup in the crankcase 15 will result in an increased oil consumption since the crankcase 15 will have a higher pressure than the combustion chamber during a portion of the engine operating cycle. To prevent such a pressure buildup, the crankcase 15 is vented through a check valve 18, which may be a conventional reed type valve typically found in small engines. The check valve 18 may vent the crankcase either to atmosphere or, preferably, to an engine air intake (not shown) to reduce air polution. As a consequence of the check valve 18, the crankcase 15 will have an average vacuum or subatmospheric gas pressure. The average crankcase vacuum will be cyclic and vary from a maximum magnitude when the piston 11 is at the top of its stroke to zero or a slight positive pressure at the bottom of the piston stroke.

A small diameter tube 19 is connected from a location on the crankcase 15 above the maximum oil surface level to a surge chamber or accumulator tank 20. The tank 20 functions to average the magnitude of the cyclic vacuum in the crankcase 15. If further damping is needed, a weighted or spring loaded damping piston (not shown) can be incorporated as part of the switch 22. If desired, a gauge 21 is connected to show the average crankcase vacuum at the tank 20. If the engine 10 is to be operated at a constant speed and a fairly constant load, the gauge 21 can be calibrated to indicate the approximate level or volume of oil in the crankcase 15. If the tank 20 is connected to the crankcase 15 of an existing engine, the tube 19 can be connected from the tank 20 to an existing dipstick tube (not shown) on the engine.

In order to protect the engine 10 from damage resulting from operation with insufficient lubricating oil 16, a vacuum switch 22 is actuated to disable the existing engine ignition system 23 to stop the engine 10 when the magnitude of the average crankcase vacuum drops below a predetermined level which indicates that there is insufficient oil in the crankcase 15. The switch 22 may be mechanically actuated by a vacuum sensing diaphragm or piston connected to the tank 20.

It will be appreciated that prior to starting the engine, there will be no vacuum in the crankcase 15. This lack of vacuum will cause the switch 22 to disable the ignition system 23 and prevent starting of the engine 10. The choke or throttle control 24 normally used to facilitate starting of the engine 10 can be connected to mechanically or electrically disable the switch 22 when the engine 10 is started. The crankcase vacuum will immediately build up upon cranking and starting the engine. When the choke or throttle control 24 is moved from the "choke" or "start" position to the "run" position, the switch 22 is enabled to sense the average crankcase vacuum and hence sense the volume of oil in the crankcase.

Figure 3:
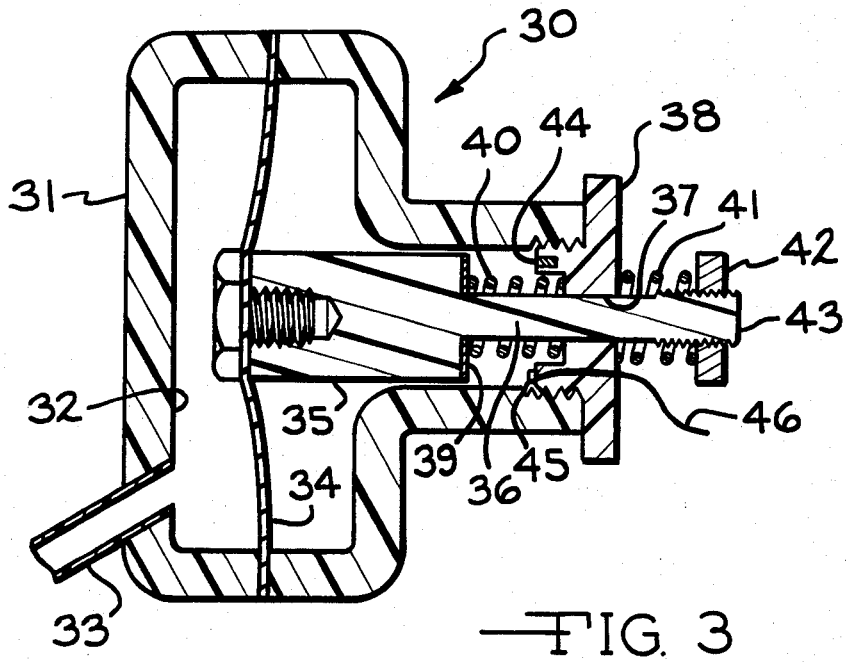
FIG. 3 is a cross sectional view through an exemplary low vacuum actuated switch for use in the apparatus of FIG. 2.

FIG. 3 is a cross section through a diaphragm actuated switch 30 which may be used as the low vacuum sensing switch 22 in the system of FIG. 2. The switch 30 has a housing 31 defining a vacuum chamber 32 which is connected through a tube 33 either to the tank 20 in FIG. 2 or to the engine crankcase 15 if the chamber 32 is sufficiently large and the tube 33 is sufficiently small in diameter to filter out cyclic pulsations in the crankcase vacuum. A flexible diaphragm 34 forms one wall of the chamber 32. As the magnitude of the vacuum in the chamber 32 changes, the diaphragm 34 flexes to move a piston 35. The piston 35 is connected to a rod 36 which slides through an opening 37 in a cap 38 which closes the housing 31. A steel washer 39 is located on the rod 36 to abut the piston 35 and a calibrated spring 40 is located on the rod 36 between the washer 39 and the cap 38. A second calibrated spring 41 is located on the rod 36 between the cap 38 and an adjustment nut 42 threaded onto the outer end 43 of the rod 36. A magnet 44 and electrical contacts 45 are located on an interior edge of the cap 38. The contacts 45 are connected through wires 46 to the engine ignition system.

In operation, the springs 40 and 41 are selected and the nut 42 is adjusted such that the piston moves the washer 39 into contact with the electrical contacts 45 when the average engine crankcase vacuum drops to a preselected level. When the washer 39 is moved against the contacts 45, the engine ignition system is either shorted to ground or open circuited to stop the engine. The magnet 44 functions as a latch to hold the washer 39 against the contacts 45 until the rod end 43 is manually pushed to reset the switch 30. It should be noted that in addition to positioning the piston 35, the diaphragm 34 also isolates the switch contacts 45 from the atmosphere in the chamber 32 which may contain oil droplets.

Figure 4:
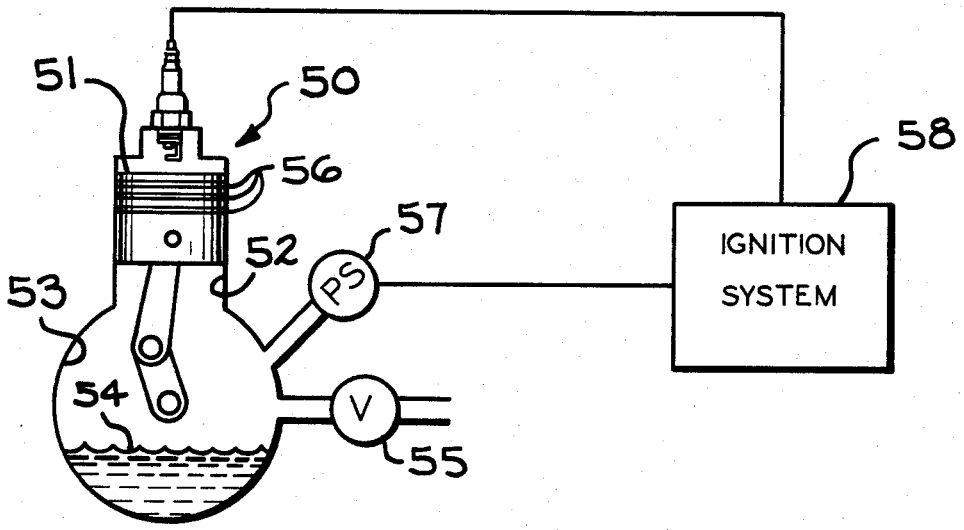
FIG. 4 is a diagramatic illustration of an engine operated in accordance with a modified embodiment of the invention.

FIG. 4 shows a modified system for stopping an internal combustion engine 50 in response to the magnitude of the average crankcase vacuum. The engine 50 has a piston 51 which reciprocates in a cylinder 52. A crankcase 53 located below the piston 51 contains a volume of lubricating oil 54. A crankcase vacuum responsive check valve 55 vents positive pressures from the crankcase 53 on the down strokes of the piston 51 so long as the crankcase vacuum on the up strokes of the piston exceeds a predetermined magnitude. If the volume of oil 54 in the crankcase 53 drops below a predetermined level, the magnitude of the vacuum drops and the valve 55 closes. The pulsating gas pressure within the crankcase 53 will increase to an above atmospheric pressure due to combustion gases blowing by the piston rings 56. The positive or above atmospheric gas pressure in the crankcase 53 actuates a conventional pressure responsive switch 57 at a preselected pressure, e.g., 1 psig, to stop the engine 50 by disabling the engine's ignition system 58, either by shorting the ignition system 58 to ground or by opening a circuit in the ignition system 58. The switch 57 can be a latching switch for preventing engine restarting without first resetting the switch 57 and for indicating the reason the engine stopped, if desired.

Figure 6:
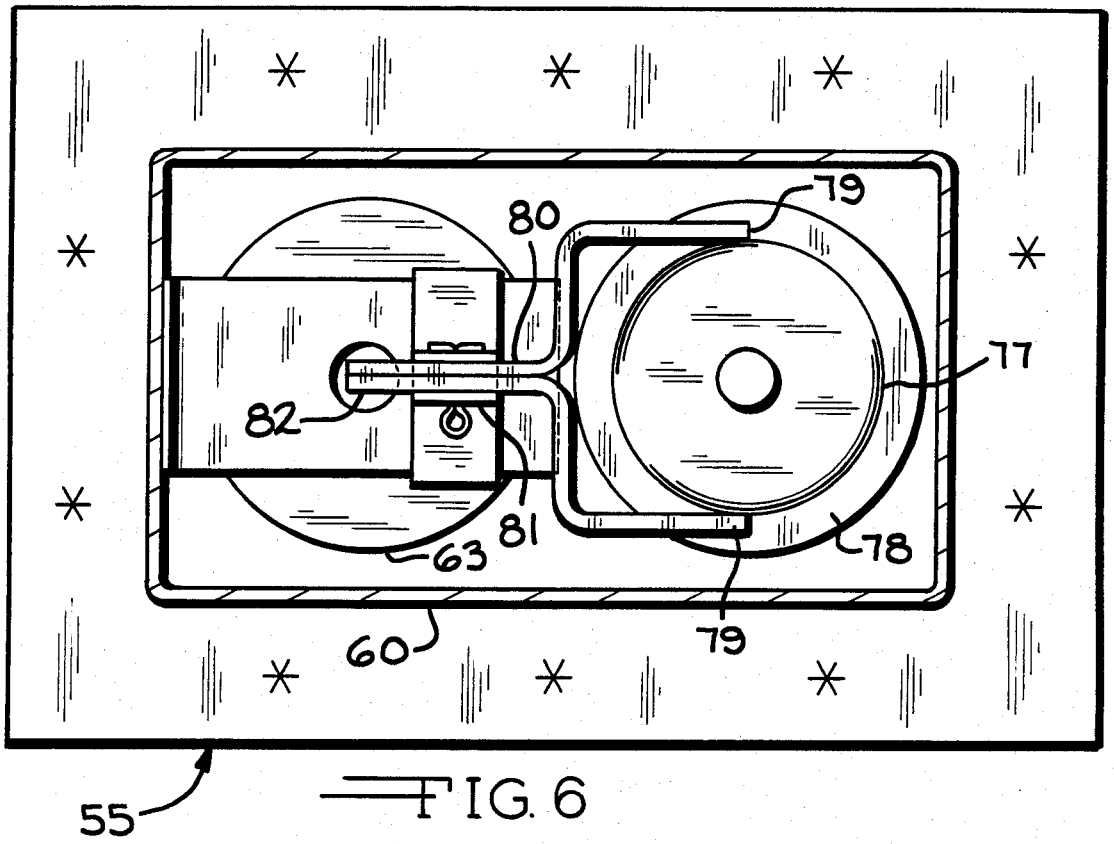
FIG. 6 is a cross sectional view taken along line 6—6 of FIG. 5.
Figure 5:
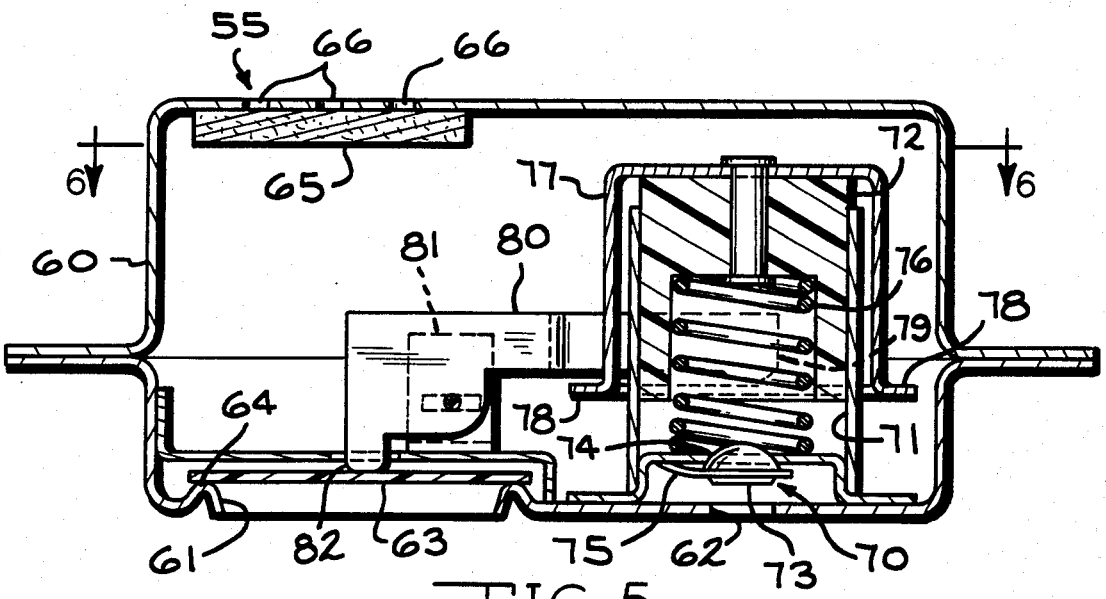
FIG. 5 is a cross sectional view through a crankcase vacuum responsive check valve for use in the embodiment of the invention illustrated in FIG. 4.

Details of an exemplary crankcase vacuum controlled check valve 55 are shown in FIGS. 5 and 6. The valve 55 has a housing 60 which defines two openings 61 and 62 which communicate with the engine crankcase 53 (FIG. 5). A conventional valve reed 63 is confined to loosely cover the inside of the opening 61 to form a check valve which vents above atmospheric pressure from the engine crankcase. The reed 63 moves away from a seat 64 to vent the engine crankcase gases in response to positive pressures. The vented gases pass through a filter 65 and vent openings 66 in the housing 60. Negative crankcase pressures draw the reed 63 into contact with the seat 64 to allow a vacuum buildup in the engine crankcase.

The opening 62 connects the engine crankcase through a vacuum check valve 70 to the interior of a cylinder 71 in which a piston 72 slides. The check valve 70 comprises a resilient valve member 73 which is urged against a seat 74 by a spring 75. The piston is preferably made from a low friction material such as polytetrafluoroethylene (Teflon) to slide easily within the cylinder 71 while closely engaging the walls of the cylinder 71. A calibrated spring 76 urges the piston 72 away from the check valve 70. An inverted cup-shaped member 77 is attached to the piston 72 to extend over the outside of a portion of the cylinder 71. The member 77 has a radial flange 78 which is engaged by forked ends 79 on a lever arm 80. As the piston 72 moves the member 78, the arm 80 is pivoted on a bracket 81. Another end 82 on the arm 80 abuts the center of the crankcase vent check valve reed 63.

In operation of the engine with sufficient oil in the crankcase, the crankcase vacuum pulls the piston 72 into the cylinder 71 against the spring 76. The valve reed 63 is free to move and positive pressure within the crankcase is vented between the valve reed 63 and the seat 64 and thence through the filter 65 and the vent openings 66. As oil is consumed or otherwise lost from the engine crankcase, the peak crankcase vacuum will decrease. As a consequence, the piston 72 will not move as far into the cylinder 71. When the crankcase oil volume drops to a predetermined level determined by the calibrated spring 76, the piston will move only a small amount and the flange 78 on the cup 77 will pivot the arm 80 to hold the valve reed 63 against the valve seat 64. This stops the venting of positive gas pressure from the crankcase. Combustion gases blown by the piston rings 56 (FIG. 4) now cause the crankcase pressure to build up. When the crankcase pressures reach a predetermined level, such as 1 psig, the pressure switch 57 stops the engine 50.

It will be appreciated that the above described method will function with any engine in which the crankcase gas pressure has a substantial pulsation as the piston or pistons reciprocate and also has a significant percentage change in the gas volume in the crankcase as the oil volume decreases from the normal full level to a dangerously low level. For larger engines, the volume of gas in the crankcase may be too large to provide sufficient pressure fluctuations as the piston or pistons reciprocate. Also, the small percentage change in the gas volume in the crankcase from a full oil state to a dangerously low oil state may be difficult to sense with a mechanical sensor. The method also is applicable to reciprocating piston compressors and other types of reciprocating piston engines besides spark ignited internal combustion engines.

We claim:

1. In a reciprocating piston engine having a crankcase containing a lubricating oil and having a crankcase gas pressure which varies as the piston reciprocates, a method for sensing a low crankcase oil volume while the engine is operating comprising the steps of: venting through a check valve positive pressure gas in the crankcase to maintain an average vacuum in the crankcase of the operating engine, such vacuum decreasing in average magnitude as the volume of oil in the crankcase decreases; and determining from the magnitude of the crankcase vacuum when there is insufficient oil in the crankcase.

2. A method for sensing a low crankcase oil volume in an operating reciprocating piston engine, as set forth in claim 1, wherein insufficient oil in the crankcase is determined by a crankcase vacuum responsive switch.

3. A method for sensing a low crankcase oil volume in an operating reciprocating piston engine, as set forth in claim 2, wherein the engine is a spark ignited internal combustion engine having an ignition system, and including the step of stopping the engine by said switch disabling the engine ignition system when the magnitude of the crankcase vacuum falls below a predetermined level.

4. A method for sensing a low crankcase oil volume in an operating reciprocating piston engine, as set forth in claim 1, and further including the steps of closing said check valve in response to determining that there is insufficient oil in the crankcase whereby a positive pressure builds up in said crankcase, and stopping the engine in response to the build up of positive pressure in said crankcase.

5. A method for sensing a low crankcase oil volume in an operating reciprocating piston engine, as set forth in claim 4, wherein the engine is a spark ignited internal combustion engine having an ignition system, and wherein the engine is stopped by disabling the ignition system in response to the built up positive pressure in said crankcase.

6. An engine comprising a reciprocating piston, a housing for said piston including a closed crankcase containing a volume of lubricating oil and a volume of gas which varies in pressure as said piston reciprocates, check valve means for venting positive gas pressure from said crankcase to maintain an average vacuum in said crankcase as said piston reciprocates, the average crankcase vacuum decreasing in magnitude as the volume of crankcase oil decreases and the volume of crankcase gas increases, and means responsive to the average crankcase vacuum for indicating when there is insufficient lubricating oil in said crankcase.

7. An engine, as set forth in claim 6, wherein said means responsive to the average crankcase vacuum includes a switch, means responsive to the magnitude of the average crankcase vacuum when there is insufficient lubricating oil in the crankcases for actuating said switch, and means responsive to actuation of said switch for stopping said engine.

* * * * *